United States Patent [19]

Haas et al.

[11] 4,074,276

[45] Feb. 14, 1978

[54] MAGNETIC IMAGING SYSTEM USING HEAT

[75] Inventors: Werner E. L. Haas; Eugene C. Faucz, both of Webster, N.Y.

[73] Assignee: Xerox Corporation, Stamford, Conn.

[21] Appl. No.: 690,129

[22] Filed: May 26, 1976

[51] Int. Cl.[2] ..... G03G 19/00

[52] U.S. Cl. ..... 346/74.1; 427/47

[58] Field of Search ..... 346/74.1; 427/53, 55, 427/47, 48, 271, 277, 202

[56] References Cited

U.S. PATENT DOCUMENTS

| | | | |
|---|---|---|---|
| 2,836,147 | 5/1958 | McComb | 346/74.1 |
| 2,856,284 | 10/1958 | Hamm | 346/74.1 |
| 2,970,299 | 1/1961 | Epstein | 346/74.1 |
| 3,120,806 | 2/1964 | Supernowicz | 346/74.1 |
| 3,641,585 | 2/1972 | Hodges | 346/74.1 |
| 3,852,525 | 12/1974 | Ichioka | 346/74.1 |
| 3,978,247 | 8/1976 | Braudy | 427/271 |

OTHER PUBLICATIONS

IBM Technical Discl. Bulletin, vol. 7, #3, p. 224, Aug. 1964 "Printing by Means of a Laser Beam" Roshon & Young.

IBM Tech. Discl. Bulletin vol. 9, #11, p. 1592, Apr. 1967 "Distillator Printing", Woodward.

*Primary Examiner*—Jay P. Lucas

*Attorney, Agent, or Firm*—James J. Ralabate; James P. O'Sullivan; George J. Cannon

[57] ABSTRACT

A magnetic imaging system wherein a magnetizable recording member comprising a substrate overcoated with a magnetic recording layer of magnetic particles dispersed in a binder is exposed to high energy light pulses of sufficient energy effective to cause or allow the removal of said magnetic recording layer in exposed regions thereof. Imagewise configured high energy light pulses result in the removal of imagewise configured portions of the magnetic recording layer. Removal of portions of the magnetic recording layer can occur either before or after magnetization of the magnetizable recording member and upon development with magnetic toner, a complementary magnetic toner image is formed and can be transferred to a receiving medium to form hard copy. The system is particularly applicable to the formation of a magnetic master which is used to form the same magnetic toner image numerous times.

16 Claims, 5 Drawing Figures

MAGNETIC IMAGING SYSTEM USING HEAT

BACKGROUND OF THE INVENTION

This invention relates to magnetic masters; and more particularly to the formation of a magnetic master in imagewise configuration.

There has recently been introduced a magnetic imaging system which employs a latent magnetic image on a magnetizable recording member which can then be utilized for purposes such as electronic transmission or in a duplicating process by repetitive toning of the latent magnetic image with magnetic toner. Such magnetic imaging schemes are disclosed in U.S. Pat. No. 3,804,511 to Rait et al; in U.S. Pat. No. 3,626,114; in U.S. Pat. No. 2,793,135 wherein a premagnetized surface is thermoremanently erased and in U.S. Pat. Nos. 3,611,415 and 3,368,209 wherein latent magnetic images are thermoremanently formed and developed. In a duplicating process wherein it is desired to form the same magnetic toner image through repetitive processes, it is highly desirable to provide a simple efficient method of forming a magnetic master. Presently, magnetic masters are formed by the processes which typically require more than one or two operations on the magnetizable recording member. For example, in U.S. Pat. No. 3,804,511, an optical image is xerographically reproduced with electroscopic toner comprising a magnetic material. After formation of the electroscopic toner image, the toner image is magnetized and this imagewise pattern of magnetization is transferred to a magnetizable recording member. This member, in turn, is developed with magnetic toner for the production of a copy of the image.

In new and growing areas of technology, it is often desirable to provide components prepared by relatively simple procedures.

SUMMARY OF THE INVENTION

It is, therefore, an object of this invention to provide a novel magnetic imaging master.

It is another object of this invention to provide a novel process for forming a magnetic imaging master.

It is a further object of this invention to provide a one and at most a two, step process for forming a magnetic imaging master.

The foregoing objects and others are accomplished in accordance with this invention by removing in imagewise configuration portions of the magnetic recording layer comprising exposure of the magnetizable recording member to high energy radiation in imagewise configuration. This results in a magnetizable recording member having upon a substrate a magnetic recording layer comprising magnetic particles dispersed in a binder, the magnetic recording layer being in a configuration complementary to the imagewise configuration of the high energy light. Thus, for any particular given image, if the high energy light is in image configuration, the resulting magnetic recording layer is in background configuration; or, if the high energy light is in background configuration the resulting magnetic recording layer is in image configuration. The exposure of the magnetizable recording member to high energy light can occur prior to or subsequent to magnetization of the magnetizable recording member, and can even be practiced subsequent to magnetizing and developing with magnetic toner the entire surface of the magnetic recording layer.

DETAILED DESCRIPTION OF THE PREFERRED EMBODIMENTS

Figure 1:
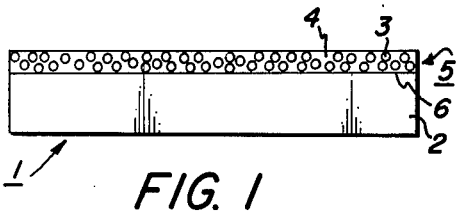

Referring now to FIG. 1, there is seen a magnetizable recording member 1 comprising a transparent substrate 2 having provided thereon a magnetic recording layer 5 comprising magnetic particles 3 dispersed in a binder 4. The magnetic recording layer is bound to transparent substrate 2 at interface 6 between transparent substrate 2 and magnetic recording layer 5. In accordance with the practice of the present invention, a high energy light pulse is applied to magnetizable recording member 1 through transparent substrate 2. The high energy light pulse is depicted in imagewise configuration 7 in FIG. 2. The imagewise light 7 can be conveniently formed by any conventional method such as, for example, the passing of uniform radiation 11 through a mask 8 comprising transparent portions 9 blocked in imagewise configuration by opaque portions 10. The high energy light reaching interface 6 is absorbed by binder 4 and the binding force at interface 6 between binder 4 and transparent substrate 2 is sufficiently weakened to allow the removal of portions 12 and 13 of magnetic recording layer 5 which correspond to the exposed portions of interface 6.

Figure 3:
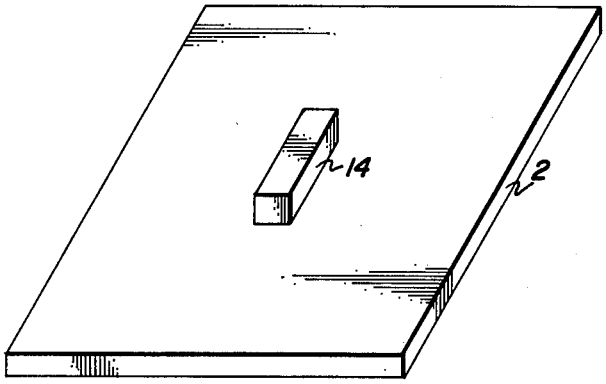
Figure 5:
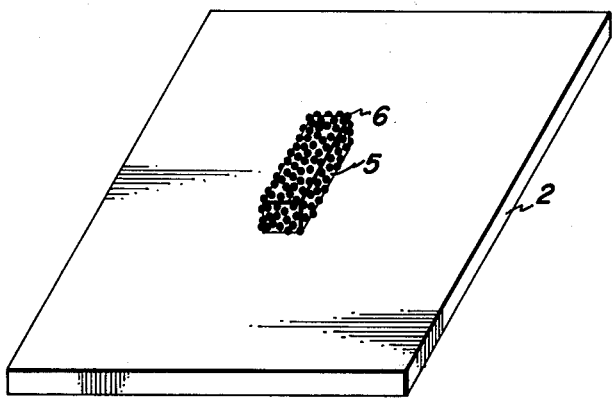
Figure 4:
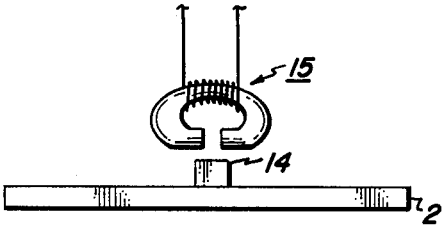

This can be more clearly seen in FIG. 3 wherein portion 14 of magnetic recording layer 5 is all that remains on transparent substrate 2 of magnetizable recording member 1. As shown in FIG. 4, remaining portions 14 of magnetic recording 5 is magnetized by conventional means, such as for example, a magnetic recording head 15. This results in the formation of magnetization patterns in portion 14 of magnetic recording layer 5 surrounded by non-magnetized surface areas of transparent substrate 2. This isolated magnetization pattern is a latent magnetic image which can then be developed by contacting with magnetic toner 6 as depicted in FIG. 5. While the drawings show the preferred embodiment of the invention wherein magnetic recording layer 5 is provided in imagewise configuration prior to magnetization and development, it will be readily appreciated that since the invention involves the imagewise destruction or weakening of the binding forces at interface 6, that the invention can be practiced any time prior to transfer of magnetic toner to a receiving medium to form a hard copy. Thus, the present invention can be practiced prior to magnetization and development; after magnetization of the entire recording layer 5 but prior to development with magnetic toner or, subsequent to both magnetization and toner development of the entire recording layer 5.

Figure 2:
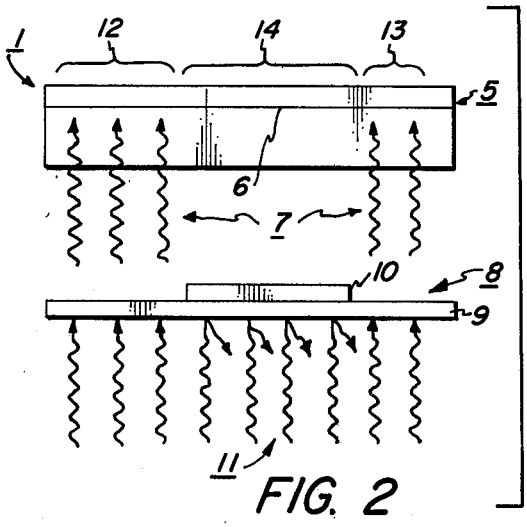

Preferred energy ranges and pulse duration ranges for high energy light pulses found to provide best results with conventional magnetic recording layers comprising magnetic particles dispersed in a binder are: from about 0.05 to about 0.5 joules per centimeter square for light pulse durations of about 50 microseconds. It will be readily appreciated that the important effect to be achieved is one of providing more energy to interface 6 than the interface can dissipate so that the binding force between binder 4 and transparent substrate 2 is destroyed or greatly weakened. When the binding force between the binder 4 and transparent substrate 2 is not destroyed or sufficiently weakened, magnetic recording member 5 can be placed in contact with an adhesive member, such as, for example, cellophane adhesive tape or other conventional adhesive members. Stripping the adhesive member away from magnetic recording layer 5 will carry with it the portions of magnetic layer 5 which correspond to the exposed portions of interface 6, thereby providing an imagewise configured magnetic recording layer 5 residing upon substrate 2. Accordingly, the necessary effect sought by this invention can be provided by using a higher or lower energy level of light and longer or shorter light pulses. When the binding force at interface 6 is destroyed, a simple and preferred exposure embodiment is one in which FIG. 2 is rotated 180° so that magnetic recording member 5 faces downward; allowing portions 12 and 13 of magnetic recording layer 5 to simply fall under the influence of gravity or to be gently dislodged by vibrations or by tapping of magnetizable recording member 1.

The magnetic imaging process utilizing the present invention results in a positive process in the sense that in the final image on paper, for example, areas of the magnetic recording layer exposed to light appear white whereas areas shielded from light appear dark and contain the magnetic toner. A positive to negative magnetic imaging process results when portions of magnetic recording layer 5 are removed by an adhesive contact layer and utilized as the master. That is, the removed portions of magnetic recording layer 5 which are complimentary to the image sense of imagewise configured high energy light 7 are magnetized and developed with magnetic toner, the magnetic toner then being transferred to a receiving medium such as paper. In this case, the white areas of the paper correspond to the non-exposed regions of magnetic recording layer 5. Thus, the practice of the present invention provides in a very straight forward manner, the capability of either a positive or negative magnetic imaging system. For a positive magnetic imaging system in accordance with the present invention, the portions of magnetic layer 5 residing on the substrate 2 are used as the magnetic imaging master; whereas, in the negative magnetic imaging system, the portions of magnetic recording layer 5 removed from transparent substrate 2 are used for the magnetic imaging master.

Typical commercially available tapes include chromium dioxide dispersed on a binder and residing on a substrate commercially available under the name of Crolyn from DuPont and $Fe_2O_3$ tape available from Minnesota Mining and Manufacturing as magnetic tape No. 871. Any high energy source of light can be utilized such as conventional flash lamps and lasers. The magnetizable recording member can be custom made by dispersing particles of conventional magnetic materials in a binder.

Typical suitable magnetic materials, include chromium dioxide, coboloy, barium ferrite, lead ferrite, strontium ferrite, samarium cobalt, aloyds of aluminum-nickel-cobalt, cobalt ferrite, magnetite, maganese arsenite, and mixtures thereof. Any "hard magnetic material" which is used herein to mean a permanent magnetic material, i.e., a magnetic material which can retain its magnetization when not subjected to the influence of a magnetic field, can be used in forming the magnetic recording layer 5. Typical suitable binders include polystyrene resins, silicone resins, acrylic resins and methacrylic polymers and copolymers and mixtures thereof. Transparent substrate 2 can comprise glass, Mylar a trademark for a polyester film available from DuPont and Tedlar, a trademark for polyvinylfluoride film also available from DuPont. Any other transparent or opaque substrate can be utilized in the invention.

EXAMPLE I

A chromium oxide magnetic recording tape, commercially available from DuPont under the Trademark Crolyn, is positioned vertically from a Xenon flash lamp at a distance sufficent to provide a light exposure level striking the chromium dioxide side of the tape at an energy level of about 0.5 joules per centimeter square. The chromium dioxide side of the tape faces the Xenon flash lamp. A transparency mask is inserted between the flash lamp and the magnetic tape. The flash lamp is energized for about 50 microseconds. The magnetic tape is then recorded with a recording head and thereby provided with a spatial pattern of magnetic transitions having a wavelength of about 10 microns. The recorded tape is then contacted with magnetic toner commercially available from Surface Processes Inc. of Pennsylvania under the trademark MAGNETOFAX 611. Excessive toner is removed from the magnetic tape by air knife leaving a pattern of magnetic toner magnetically attracted to the magnetic tape in a configuration corresponding to the opaque mask portion of the mask transparency. The magnetic toner image is transferred to a sheet of paper providing an image of excellent contrast.

EXAMPLE II

Example 1 is repeated except that the substrate side of the magnetic tape faces the flash lamp and is positioned from the flash lamp at a distance such that the light energy striking the substrate is about 0.05 Joules per centimeter square. Upon development with magnetic toner, the magnetic toner substantially uniformly covers the magnetic tape.

EXAMPLE III

Example II is followed except that inbetween recording the magnetic tape with the recording head and developing with magnetic toner, a wide strip of cellophane adhesive tape is placed in adhesive contact with the chromium dioxide side of the magnetic tape and then pulled away therefrom carrying with it portions of the chromium dioxide side of the tape in imagewise configuration corresponding to the transparent portions of the mask transparency. Development of the magnetic tape with magnetic toner, removal of excessive magnetic toner and transfer of magnetic toner from the tape to a sheet of paper produces a visible image of excellent contrast wherein the image corresponds to the masked, opaque portions of the mask transparency.

EXAMPLE IV

The strip of cellophane adhesive tape bearing imagewise configured portions of the chromium dioxide side of the magnetic tape obtained in Example III is passed beneath the recording head so as to magnetize the chromium dioxide. Upon development with magnetic toner and transfer of the toner to a sheet of paper, a magnetic toner image of excellent contrast is observed. The visible image of magnetic toner on the paper is in an image configuration corresponding to transparent portions of the mask transparency.

EXAMPLES V–IX

Examples I–IV are repeated except that the magnetic tape comprises ferric oxide dispersed in a binder, commercially available from Minnesota Mining and Manufacturing as magnetic tape No. 871. No visible differences are detected from the results obtained in Examples I–IV.

EXAMPLES X–XI

Example I is repeated with the chromium dioxide tape in Example X and with the ferric oxide tape in Example XI. In each of the repetitions of Example I the only difference from Example I is that the magnetic tape is turned around so that the substrate side of the tape faces the lamp source. In both repetitions, the results are substantially the same as for Example I.

Other modifications and ramifications of the present invention will occur to those skilled in the art upon a reading of the present disclosure. These are intended to be included within the scope of this invention.

For example, in magnetic tapes lacking a transparent substrate but rather having an opaque substrate, the present invention will be practiced, of course, by exposing the magnetic side of the tape directly to the high energy light. Further, it would be apparent that the present invention can be practiced in the environment of an automated machine wherein lasers are utilized to optically scan an original document and control through interfacing electronic circuitry a laser which writes upon the magnetic tape.

What is claimed is:

1. A magnetic imaging process, comprising: providing a magnetizable recording member comprising a substrate overcoated with a magnetic recording layer of magnetic particles dispersed in a binder; and exposing one of said substrate and said magnetic recording layer to light, thereby leaving said unexposed regions of said magnetic recording layer in said image configuration on the substrate in two locations at an energy level at about 0.05 to about 0.5 Joules per centimeter square for a period of time effective to at least weaken the binding force between said binder and said substrate to at least allow removal of said magnetic recording layer in regions thereof corresponding to exposed regions of said recording member upon contact of said magnetic recording layer with an adhesive member, thereby leaving said unexposed regions of said magnetic recording layer in said image configuration on the substrate in two locations.

2. The process of claim 1 wherein said light is provided by a laser.

3. The method of claim 1 further including the step of contacting said magnetic recording layer with an adhesive member and removing said adhesive member from contact with said recording layer whereby said adhesive member bears exposed portions of said magnetic recording layer which are thereby removed from said magnetic recording layer.

4. The process of claim 3 further including the step of magnetizing the exposed portions of said magnetic recording layer residing on said adhesive member.

5. The process of claim 4 further including the step of contacting said magnetized, exposed portions of magnetic recording layer residing on said adhesive member with magnetic toner.

6. The process of claim 5 further including the step of transferring said magnetic toner to a receiving medium.

7. The process of claim 6 wherein said receiving medium is paper.

8. A magnetic imaging process, comprising:

a. providing a magnetizable recoding member comprising a substrate overcoated with a magnetic recording layer comprising magnetic particles dispersed in a binder;

b. exposing one of said substrate and said magnetic recording layer to light, thereby leaving said unexposed regions of said magnetic recording layer in said image configuration on the substrate in two locations at an energy level of from about 0.05 to about 0.5 Joules per centimeter square for a period of time effective to remove the portions of said magnetic recording layer corresponding to exposed regions of said recording member, thereby leaving said unexposed regions of said magntic recording layer in said image configuration on the substrate in two locations.

9. The process of claim 8 wherein said substrate is transparent and said recording member is exposed through said transparent substrate.

10. The process of claim 8 wherein said substrate is opaque and wherein said magnetic recording layer of said recording member is directly exposed to said light.

11. The process of claim 8 wherein said light is provided by a laser.

12. The process of claim 8 further including the step of magnetizing said magnetic recording layer and contacting said magnetized recording layer with magnetic toner.

13. The method of claim 12 wherein said magnetizing step precedes such exposure step.

14. The process of claim 13 wherein said step of contacting said magnetized recording layer with magnetic toner precedes said exposure step.

15. The process of claim 12 further including the step of transferring said magnetic toner from said recording member to a receiving medium.

16. The process of claim 5 wherein said receiving medium is paper.

* * * * *

UNITED STATES PATENT AND TRADEMARK OFFICE

CERTIFICATE OF CORRECTION

PATENT NO. : 4,074,276

DATED : February 14, 1978

INVENTOR(S) : Werner E. L. Haas; Eugene C. Faucz

It is certified that error appears in the above-identified patent and that said Letters Patent are hereby corrected as shown below:

Column 5, line 34, Claim 1, after the word "light," delete "thereby leaving said unexposed regions of said magnetic recording layer in said image configuration on the substrate in two locations" and insert therefor --in the negative of an image configuration--.

Claim 1, line 45, after "substrate", delete "in two locations".

Column 6, Claim 8, line 20, after the word "light," delete, "thereby leaving said unexposed regions of said magnetic recording layer in said image configuration on the substrate in two locations" and insert therefor --in the negative of an image configuration--.

Claim 8, line 28, correct the spelling of magnetic.

Claim 8, line 30, after "substrate" delete, "in two locations".

Claims 1 and 8 should read as follows:

1. A magnetic imaging process, comprising: providing a magnetizable recording member comprising a substrate overcoated with a magnetic recording layer of magnetic particles dispersed in a binder; and exposing one of said substrate and said magnetic recording layer to light in the negative of an image configuration at an energy level at about 0.05 to about 0.5 Joules per centimeter square for a period of time effective to at least weaken the binding force between said binder and said substrate to at least allow removal of said magnetic recording layer in regions thereof corresponding to exposed regions of said recording member upon contact of said magnetic recording layer with an adhesive member thereby leaving said unexposed regions of said magnetic recording layer in said image configuration on the substrate.

UNITED STATES PATENT AND TRADEMARK OFFICE

CERTIFICATE OF CORRECTION

PATENT NO. : 4,074,276

DATED : February 14, 1978

INVENTOR(S) : Werner E. L. Haas; Eugene C. Faucz

It is certified that error appears in the above-identified patent and that said Letters Patent are hereby corrected as shown below:

8. A magnetic imaging process, comprising:

(a) providing a magnetizable recording member comprising a substrate overcoated with a magnetic recording layer comprising magnetic particles dispersed in a binder;

(b) exposing one of said substrate and said magnetic recording layer to light in the negative of an image configuration, at an energy level of from about 0.05 to about 0.5 Joules per centimeter square for a period of time effective to remove the portions of said magnetic recording layer corresponding to exposed regions of said recording member thereby leaving said unexposed regions of said magnetic recording layer in an image configuration on the substrate.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*